US007562998B1

(12) United States Patent
Yen

(10) Patent No.: US 7,562,998 B1
(45) Date of Patent: Jul. 21, 2009

(54) MATRIX LED LIGHT TUBE GAIN STRUCTURE

(76) Inventor: Hsu-Li Yen, 3F-2, No. 13, Wu Chuan 1 Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 12/155,567

(22) Filed: Jun. 6, 2008

(51) Int. Cl.
*F21S 4/00* (2006.01)

(52) U.S. Cl. ..... 362/219; 362/240; 362/249

(58) Field of Classification Search ..... 362/217, 362/219, 221, 222, 235, 240, 249, 551, 555, 362/800; 313/500, 502
See application file for complete search history.

(56) References Cited

U.S. PATENT DOCUMENTS 5,607,227 A * 3/1997 Yasumoto et al. ..... 362/249.06
6,659,622 B2 * 12/2003 Katogi et al. ..... 362/219
6,874,924 B1 * 4/2005 Hulse et al. ..... 362/551
7,488,086 B2 * 2/2009 Wu et al. ..... 362/225
2007/0274067 A1 * 11/2007 Sloan et al. ..... 362/219
2008/0298058 A1 * 12/2008 Kan et al. ..... 362/240

* cited by examiner

*Primary Examiner*—Hargobind S Sawhney
(74) *Attorney, Agent, or Firm*—Rosenberg, Klein & Lee

(57) ABSTRACT

A matrix LED light tube gain structure suitable for replacing a fluorescent lamp includes an elongate metal base having a surface portion formed with screw holes for securing a matrix LED light strip with bolts, a cover having two lateral edges each protrudingly formed with a rail, two engagement blocks, and two end caps. The elongate metal base has two lateral edges each formed with a rail groove for engaging with a corresponding one of the rails on the cover. The elongate metal base further has two ends each engaged with a corresponding one of the engagement blocks and then combined with a corresponding one of the end caps.

3 Claims, 3 Drawing Sheets

MATRIX LED LIGHT TUBE GAIN STRUCTURE

BACKGROUND OF THE INVENTION

1. Technical Field

The present invention relates to matrix LED light tube structures, and more particularly, to a matrix LED light tube gain structure.

2. Description of Related Art

Nowadays, various kinds of lamps are used to bring light to our living space. The lamps can be placed at desired locations to change the brightness of the space with the light they emit. As essential illumination devices in our daily life, the lamps not only help enhance the quality of our living space, but are also closely related to our physical health, especially the eyes.

Generally, basic lighting is necessary to provide sufficient illumination for good vision. And the most widely used lamps are the fluorescent lamps. A fluorescent lamp is a tubular lamp capable of emitting a bright light. However, fluorescent lamps emit light at relatively unstable frequency, which may be harmful to the eyes. Moreover, the production and recycling of fluorescent lamps cause mercury pollution.

As environmental awareness thrives, it has been a global trend to replace traditional lamps with matrix LED light strips which cause neither environment protection problems nor damage to human health. Particularly, the matrix LED light strips are power-efficient and provide brighter and more stable illumination than the traditional lamps, thereby qualifying the matrix LED light strips as excellent lighting devices.

However, if the tradition fluorescent lamps are to be replaced, existing lamp fixtures for the tradition fluorescent lamps must be replaced as well, which may impose a financial burden on their users.

Since it is an inevitable trend to substitute the matrix LED light strips for the traditional fluorescent lamps, the present inventor took pains in finding a way to extend the use of existing fluorescent lamp fixtures for relieving the financial burden on their users. After research and experiments, the present inventor finally succeeded in developing a matrix LED light tube structure, wherein specifications of the tube structure match specifications of the existing fluorescent lamp fixtures, thereby allowing the matrix LED light strips to be powered and emit light.

BRIEF SUMMARY OF THE INVENTION

The present invention relates to matrix LED light tube structures, and more particularly, to a matrix LED light tube gain structure. Therefore, an objective of the present invention is to provide a matrix LED light tube structure can be used to replace a fluorescent lamp. The matrix LED light tube gain structure comprises an elongate metal base having a surface portion formed with screw holes for securing a matrix LED light strip with bolts, a cover having two lateral edges each protrudingly formed with a rail, two engagement blocks and two end caps. The elongate metal base has two lateral edges each formed with a rail groove for engaging with a corresponding one of the rails on the cover. The elongate metal base further has two ends each engaged with a corresponding one of the engagement blocks and then combined with a corresponding one of the end caps.

BRIEF DESCRIPTION OF DRAWINGS

The structure and spirit of the present invention as well as a preferred mode of use, further objectives and advantages thereof will best be understood by reference to the following detailed description of an illustrative embodiment when read in conjunction with the accompanying drawings, wherein.

DETAILED DESCRIPTION OF THE INVENTION

Figure 1:
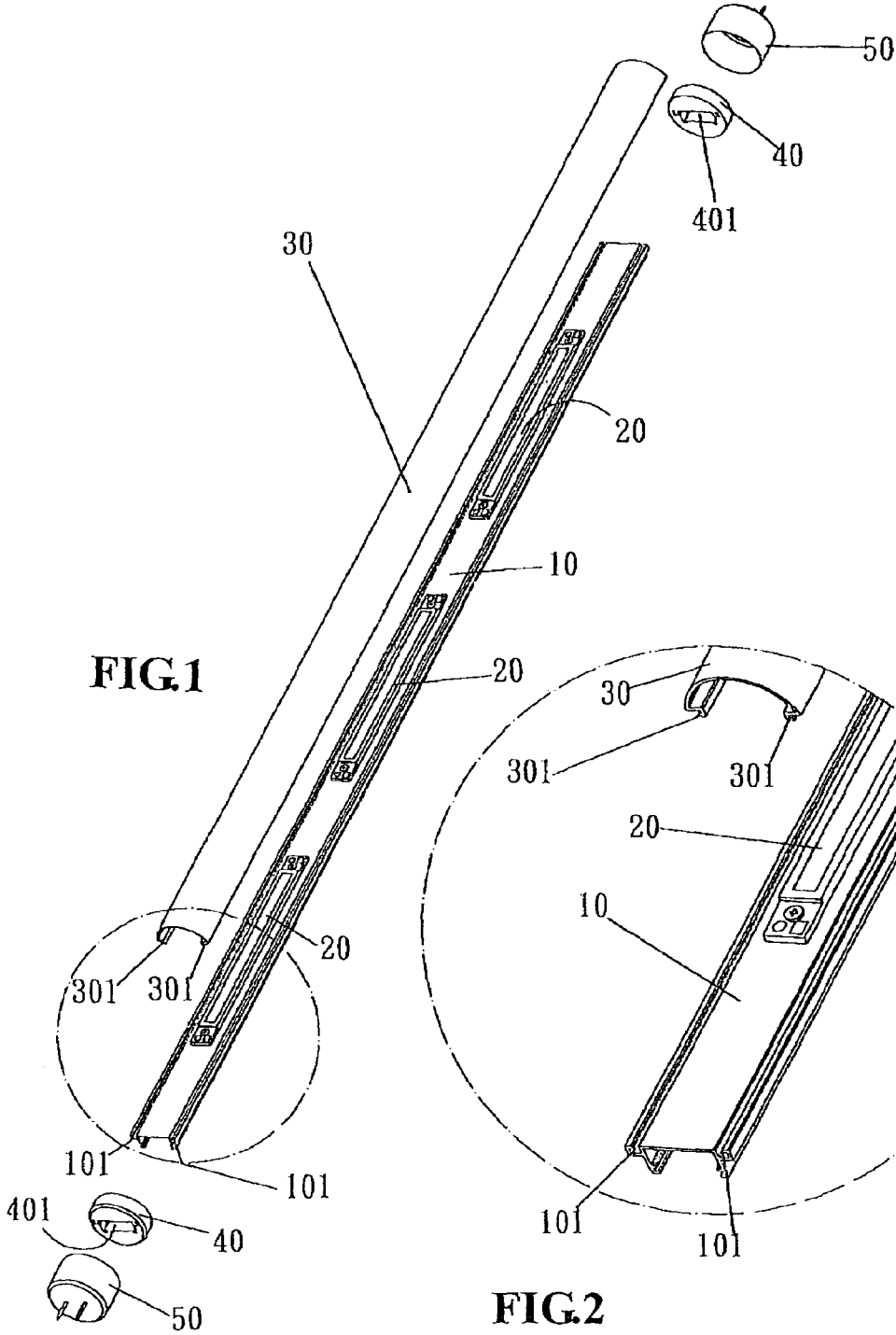
FIG. 1 is an exploded perspective view of a matrix LED light tube gain structure according to the present invention.
Figure 2:
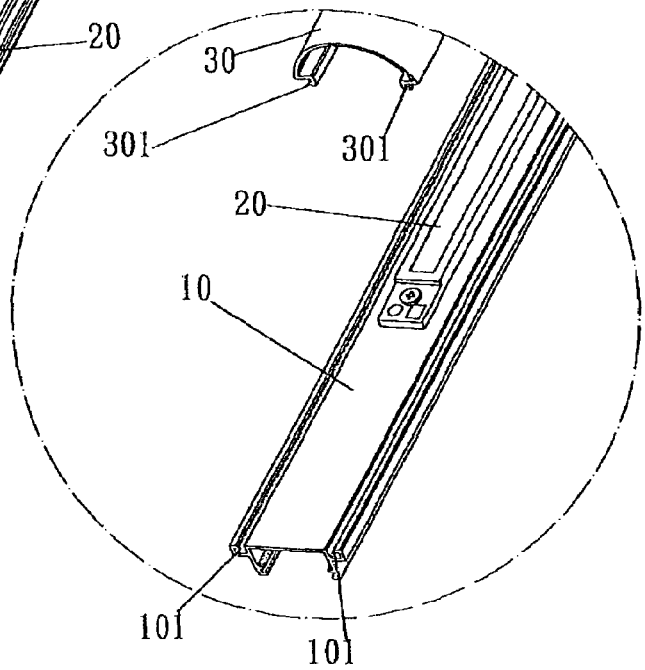
FIG. 2 is a partial, enlarged view of the matrix LED light tube gain structure according to the present invention.

FIG. 1 is an exploded perspective view of a matrix LED light tube gain structure according to the present invention, wherein the matrix LED light tube gain structure comprises:

an elongate metal base 10 having a surface portion formed with screw holes for securing a matrix LED light strip 20 (referring also to FIG. 2) with bolts, wherein the elongate metal base 10 has two lateral edges, each formed with a rail groove 101;

a cover 30 (referring also to FIG. 2) having two lateral edges each protrudingly formed with a rail 301 for engaging with a corresponding one of the rail grooves 101 formed on the two lateral edges of the elongate metal base 10;

two engagement blocks 40 each formed with a through hole 401 having the same shape as each of two ends of the elongate metal base 10 for engaging with each of the two ends of the elongate metal base 10; and two end caps 50 each having a cylindrical shape and provided with two conducting terminals.

Figure 3:
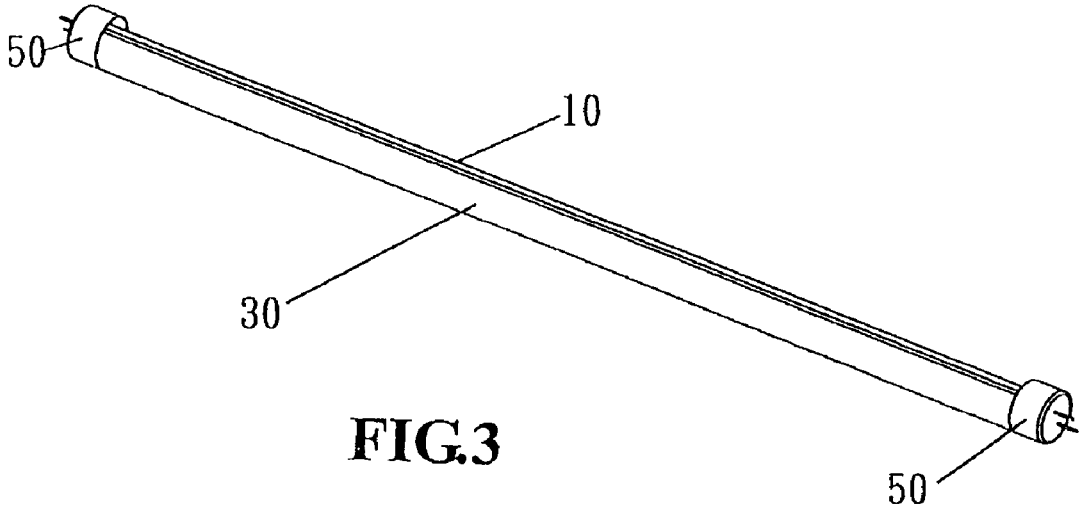
FIG. 3 is a perspective view of the matrix LED light tube gain structure according to the present invention.
Figure 4:
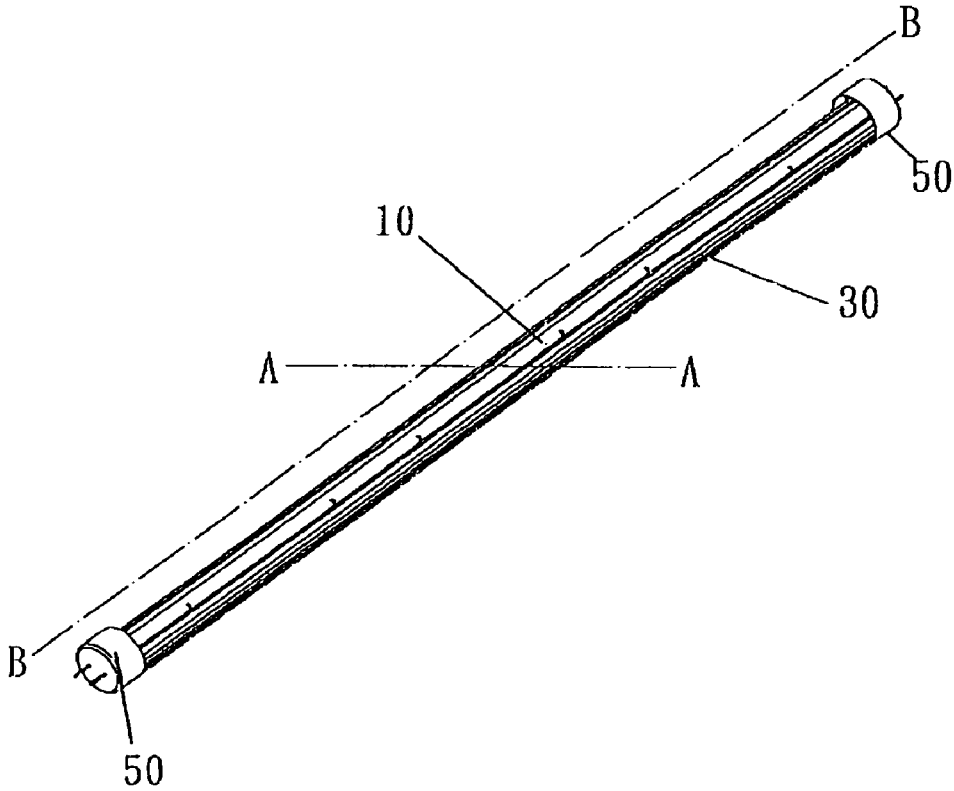
FIG. 4 is another perspective view of the matrix LED light tube gain structure according to the present invention.

Assembly of the matrix LED light tube gain structure begins by securing the matrix LED light strip 20 onto the surface portion of the elongate metal base 10 with the bolts, wherein the matrix LED light strip 20 may comprise a plurality of such matrix LED light strips 20 or only one such matrix LED light strip 20 that is extended in size (not shown). Then, the rails 301 protrudingly formed on the two lateral edges of the cover 30 are inserted into the rail grooves 101 formed on the two lateral edges of the elongate metal base 10, respectively. Following that, the two ends of the elongate metal base 10 are inserted into the through holes 401 in the engagement blocks 40, respectively, and then combined with the two end caps 50, respectively, to form the matrix LED light tube gain structure shown in FIGS. 3 and 4.

Figure 5:
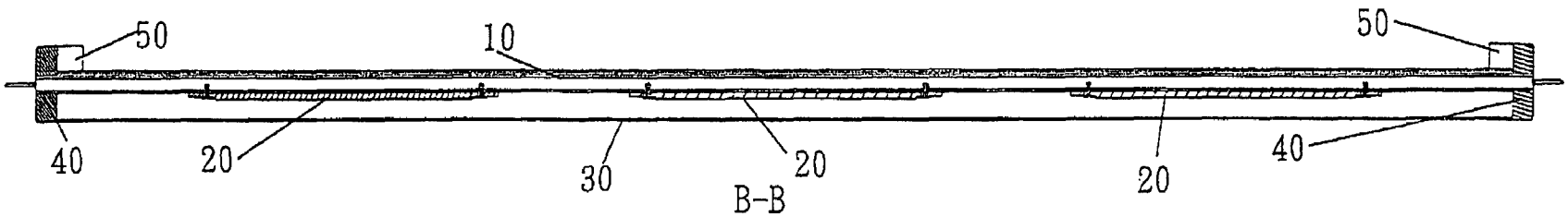
FIG. 5 is a cross-sectional view taken along a line B-B in FIG. 4.
Figure 6:
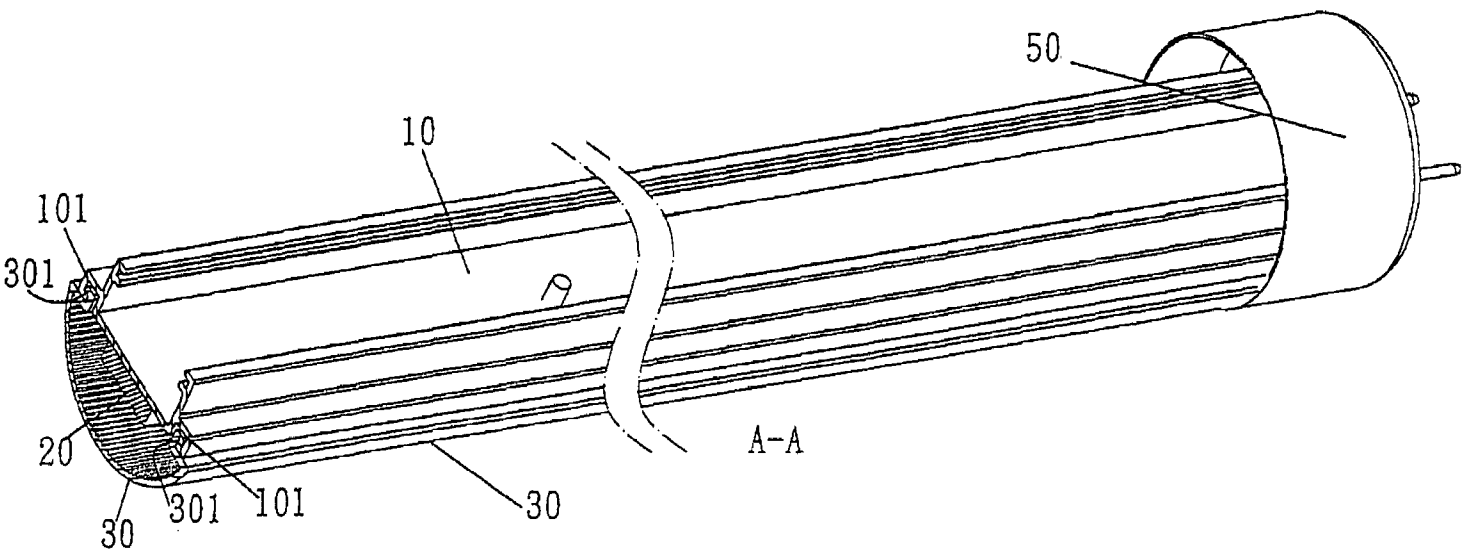
FIG. 6 is a cross-sectional view taken along a line A-A in FIG. 4.

As shown in FIGS. 5 and 6, the matrix LED light strip 20 is secured on the surface portion of the elongate metal base 10 with the bolts, so that a bottom side of the matrix LED light strip 20 is in contact with the surface portion of the elongate metal base 10. Therefore, heat generated by the matrix LED light strip 20 while the matrix LED light strip 20 is emitting light can be conducted to the elongate metal base 10 to accelerate heat dissipation and thereby increase a service life of the matrix LED light strip 20.

In summary, the matrix LED light tube gain structure of the present invention not only serves the intended purpose of replacing the traditional fluorescent lamp, but also has the same specifications as those of the traditional fluorescent lamp, allowing the matrix LED light tube gain structure of the present invention to be combined directly with connectors on an existing lamp fixture for the traditional fluorescent lamp. As the content disclosed herein has not been put to public use and meets the requirements of non-obviousness, utility and novelty for patent application, an application for patent of the present invention is hereby filed for examination.

The present invention has been described with a preferred embodiment thereof and it is understood that the embodiment is not intended to limit the scope of the present invention. Therefore, all equivalent changes or modifications whose functions and effects do not depart from the spirit of the present invention as disclosed herein are encompassed by the appended claims.

What is claimed is:

1. A matrix LED light tube gain structure, comprising:

an elongate metal base having a surface portion formed with screw holes for securing a matrix LED light strip with bolts, wherein the elongate metal base has two lateral edges each formed with a rail groove;

a cover having two lateral edges each protrudingly formed with a rail for engaging with a corresponding one of the rail grooves formed on the two lateral edges of the elongate metal base;

two engagement blocks each formed with a through hole having a same shape as each of two ends of the elongate metal base for engaging with each said end of the elongate metal base; and two end caps each having a cylindrical shape and provided with two conducting terminals;

wherein the matrix LED light tube gain structure is assembled by firstly securing the matrix LED light strip onto the surface portion of the elongate metal base with the bolts, inserting the rails on the two lateral edges of the cover into the rail grooves formed on the two lateral edges of the elongate metal base respectively, inserting the two ends of the elongate metal base into the through holes on the engagement blocks respectively, and finally combining the two ends of the elongate metal base with the two end caps respectively, thereby forming the matrix LED light tube gain structure.

2. The matrix LED light tube gain structure as claimed in claim 1, wherein the matrix LED light strip secured on the surface portion of the elongate metal base with the bolts comprises a plurality of such matrix LED light strips.

3. The matrix LED light tube gain structure as claimed in claim 1, wherein the matrix LED light strip secured on the surface portion of the elongate metal base with the bolts comprises only one such matrix LED light strip extended in size.

* * * * *